US009062360B2

(12) United States Patent
Tsuchida et al.

(10) Patent No.: US 9,062,360 B2
(45) Date of Patent: Jun. 23, 2015

(54) STEEL FOR MACHINE STRUCTURAL USE

(75) Inventors: Takehiro Tsuchida, Kobe (JP); Tomokazu Masuda, Kobe (JP); Masaki Shimamoto, Kobe (JP); Mutsuhisa Nagahama, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 54 days.

(21) Appl. No.: 13/321,902

(22) PCT Filed: Jun. 1, 2010

(86) PCT No.: PCT/JP2010/059287

§ 371 (c)(1),
(2), (4) Date: Nov. 22, 2011

(87) PCT Pub. No.: WO2010/140596

PCT Pub. Date: Dec. 9, 2010

(65) Prior Publication Data

US 2012/0063945 A1 Mar. 15, 2012

(30) Foreign Application Priority Data

Jun. 5, 2009 (JP) ..... 2009-136657

(51) Int. Cl.
*C22C 38/06* (2006.01)
*C22C 38/02* (2006.01)
(Continued)

(52) U.S. Cl.
CPC ..... *C22C 38/02* (2013.01); *C22C 38/001* (2013.01); *C22C 38/04* (2013.01); *C22C 38/06* (2013.01);
(Continued)

(58) Field of Classification Search
CPC ..... C22C 38/001; C22C 38/02
USPC ..... 420/93
See application file for complete search history.

(56) References Cited

U.S. PATENT DOCUMENTS 5,746,842 A * 5/1998 Eguchi et al. ..... 148/319
8,192,565 B2 * 6/2012 Masuda et al. ..... 148/622
(Continued)

FOREIGN PATENT DOCUMENTS

JP 06 057369 3/1994
JP 08 020841 1/1996
(Continued)

OTHER PUBLICATIONS

International Search Report Issued Sep. 7, 2010 in PCT/JP10/059287 Filed Jun. 1, 2010.
(Continued)

*Primary Examiner* — Jie Yang
(74) *Attorney, Agent, or Firm* — Oblon, McClelland, Maier & Neustadt, L.L.P.

(57) ABSTRACT

Provided is a steel for machine structural use which has excellent machinability (particularly, with respect to tool life) for both intermittent cutting with a high-speed steel tool and continuous cutting with a cemented carbide tool while maintaining strength properties required of the steel for machine structural use. Specifically, the steel for machine structural use contains C: 0.05-0.9 mass %, Si: 0.03-2 mass %, Mn: 0.2-1.8 mass %, P: 0.03 mass % or less, S: 0.03 mass % or less, Al: 0.1-0.5 mass %, N: 0.002-0.017 mass %, and O: 0.003 mass % or less, and contains one or more selected from a group consisting of Ti: 0.05 mass % or less (excluding 0 mass %) and B: 0.008 mass % or less (excluding 0 mass %), with the remainder being iron and unavoidable impurities, and satisfies all of the following inequalities (1)-(3) below:
(1): $[N]-0.3[Ti]-1.4[B]<(0.0004/[Al])-0.002$;
(2): $[Ti]-[N]/0.3<0.005$; and
(3): $[B]-([N]-0.3[Ti])/1.4<0.003$ when $[Ti]-[N]/0.3<0$ and $[B]<0.003$ when $[Ti]-[N]/0.3\geq 0$.

10 Claims, 1 Drawing Sheet

(51) Int. Cl.

| | |
|---|---|
| ***C22C 38/00*** | (2006.01) |
| ***C22C 38/04*** | (2006.01) |
| ***C22C 38/14*** | (2006.01) |
| ***C22C 38/22*** | (2006.01) |
| ***C22C 38/28*** | (2006.01) |
| ***C22C 38/32*** | (2006.01) |
| ***C22C 38/12*** | (2006.01) |

(52) U.S. Cl.
CPC ..... *C22C 38/14* (2013.01); *C22C 38/22* (2013.01); *C22C 38/28* (2013.01); *C22C 38/32* (2013.01); *C22C 38/002* (2013.01); *C22C 38/12* (2013.01)

(56) References Cited

U.S. PATENT DOCUMENTS

| | | | | |
|---|---|---|---|---|
| 2008/0247900 | A1 | 10/2008 | Hayashi et al. | |
| 2010/0193090 | A1 | 8/2010 | Masuda et al. | |
| 2012/0168035 | A1 * | 7/2012 | Tsuchida et al. ..... | 148/318 |

FOREIGN PATENT DOCUMENTS

| | | | | |
|---|---|---|---|---|
| JP | 08020841 | A | * | 1/1996 |
| JP | 09 217143 | | | 8/1997 |
| JP | 10 152746 | | | 6/1998 |
| JP | 11 029836 | | | 2/1999 |
| JP | 2004 244665 | | | 9/2004 |
| JP | 2006 002186 | | | 1/2006 |
| JP | 2007 211279 | | | 8/2007 |
| JP | 4645593 | B2 | | 12/2010 |
| KR | 2007-0021189 | A | | 2/2007 |

OTHER PUBLICATIONS

Korean Office Action dated Aug. 9, 2013, in Korean Patent Application No. 10-2011-7028879 (with English and Japanese Translations).

* cited by examiner

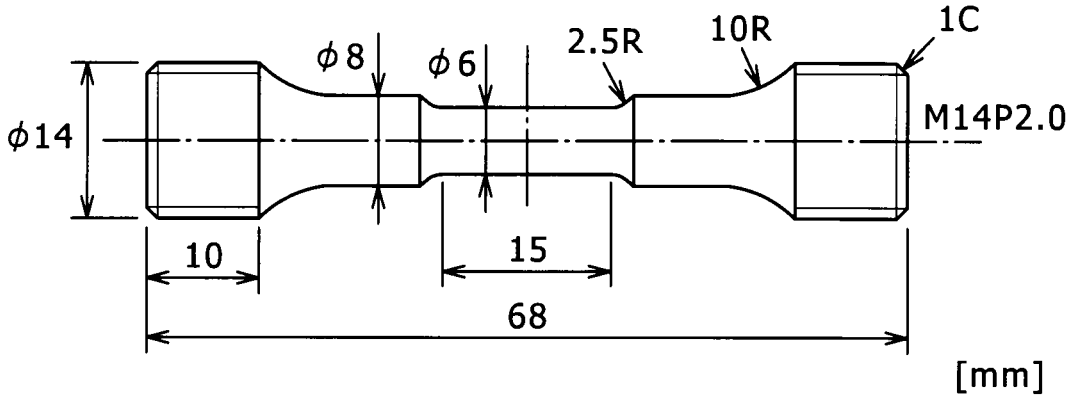
ϕ8
ϕ6
2.5R
10R
1C
ϕ14
M14P2.0
10
15
68
[mm]

STEEL FOR MACHINE STRUCTURAL USE

TECHNICAL FIELD

The present invention relates to a steel for machine structural use for manufacturing machine parts performed with cutting work, specifically to a steel for machine structural use having excellent machinability in intermittent cutting under a low speed such as hobbing and having excellent hot workability.

BACKGROUND ART

The steel for machine structural use such as a gear, shaft, pulley, constant velocity joint and the like utilized for a variety of gear transmission devices, to begin with a transmission for an automobile and a differential gear, as well as a crank shaft, con'rod and the like, is generally finished into a final shape by performing the work of forging and the like and thereafter performing cutting work. Because the cost required for the cutting work occupies a major portion in the manufacturing cost, steel material constituting the steel for machine structural use is required to be excellent in machinability. Therefore, technologies for improving machinability have been disclosed from the past.

The typical examples of such technologies are to add Pb and to form MnS by adding S. However, because Pb is hazardous for a human body, its use has come to be restricted. Also, with respect to the parts in which deterioration of the mechanical property caused by sulfide becomes a problem, there is a limit in using S. Further, in cutting work of a gear and the like particularly, gear cutting with a hob is generally performed, however, the cutting in this case differs from the continuous cutting such as what is called lathe turning but is in a manner called as the intermittent cutting. At present, steel material improving the machinability in hobbing has been scarcely materialized. The tool raw material used for a hob is a high-speed steel, and is generally performed with coating of TiAlN and the like. In this case, it is known that the tool surface wears while being oxidized by repeating cutting and idle rotation in working under a comparative low speed.

As a method for improving the intermittent cutting machinability, in the patent document 1, steel material is described which is excellent in the intermittent cutting machinability (tool life) under a high speed (cutting speed: 200 m/min or more) by containing Al: 0.04-0.20% and O: 0.0030% or less.

In the patent document 2, a steel for machine structural use is described which contains C: 0.05-1.2%, Si: 0.03-2%, Mn: 0.2-1.8%, P: 0.03% or less, S: 0.03% or less, Cr: 0.1-3%, Al: 0.06-0.5%, N: 0.004-0.025%, O: 0.003% or less respectively, contains Ca: 0.0005-0.02% and Mg: 0.0001-0.005% with solid solution N: 0.002% or more in steel, the remainder being iron and unavoidable impurities, and satisfies $(0.1\times[Cr]+[Al])/[O]\leq 150$.

Also, in the patent document 3, a steel for machine structural use is described which contains C: 0.1-0.85%, Si: 0.01-1.0%, Mn: 0.05-2.0%, P: 0.005-0.2%, total Al: exceeding 0.1% and 0.3% or less, total N: 0.0035-0.020%, with solid solution N being limited to 0.0020% or less.

DOCUMENT ON PRIOR ART

Patent Document

[Patent Document 1] Japanese Unexamined Patent Application Publication No. 2001-342539

[Patent Document 2] Japanese Patent No. 4193998

[Patent Document 3] Japanese Unexamined Patent Application Publication No. 2008-13788

DISCLOSURE OF THE INVENTION

Problems to be Solved by the Invention

However, the steel material described in the patent document 1 does not include in its object the intermittent cutting under a low speed (for example, approximately 150 m/min of the cutting speed). Also, when the Al content increases, the ductility in a hot state deteriorates, and such a problem that a crack becomes liable to occur in hot working such as hot rolling, hot forging and the like is caused.

Also, in the patent document 2, addition of Mg and Ca is the premise, and improvement of the machinability in intermittent cutting is targeted by softening of oxides of Mg and Ca. However, because Mg and Ca are liable to form sulfides also, there is a problem that the sulfides stick to the inside of a nozzle in casting and become the cause of blocking of the nozzle. Further, the patent document 2 describes that the machinability improves by securing the solid solution N quantity in steel by 0.002% or more. However, when the solid solution N quantity increases, the hot workability of the steel for machine structural use deteriorates.

Also, the patent document 3 describes that the wear of the tool is improved by limiting the solid solution N quantity by depositing mainly AlN. However, when steel material is heated to approximately 1,100° C. or above in continuous casting, hot forging and the like in manufacturing the steel material, there is a problem that AlN is solubilized and the ductility in hot working thereafter deteriorates.

The present invention was developed watching the circumstances as described above, and its object is to provide a steel for machine structural use capable of securing the manufacturability such as the hot workability and the like not by increasing the S quantity to be added which causes deterioration of the mechanical properties nor by addition of Ca and Mg, and capable of exerting excellent machinability (particularly, with respect to the tool life) in intermittent cutting (hobbing for example) under a low speed with a high-speed steel tool.

Means to solve the Problem

A steel for machine structural use in relation with the present invention that could attain the object contains C: 0.05-0.9 mass %, Si: 0.03-2 mass %, Mn: 0.2-1.8 mass %, P: 0.03 mass % or less (excluding 0 mass %), S: 0.03 mass % or less (excluding 0 mass %), Al: 0.1-0.5 mass %, N: 0.002-0.017 mass %, and O: 0.003 mass % or less (excluding 0 mass %), and contains one or more selected from a group consisting of Ti: 0.05 mass % or less (excluding 0 mass %) and B: 0.008 mass % or less (excluding 0 mass %), with the remainder being iron and unavoidable impurities, and satisfies all of inequalities (1)-(3) below.

Inequality (1): $[N]-0.3\times[Ti]-1.4\times[B]<(0.0004/[Al])-0.002$

Inequality (2): $[Ti]-[N]/0.3<0.005$

Inequality (3): $[B]-([N]-0.3\times[Ti])/1.4<0.003$ when $[Ti]-[N]/0.3<0$, and $[B]<0.003$ when $[Ti]-[N]/\geq 0.30$.

In the inequalities (1)-(3), [N], [Ti], [B] and [Al] represent the content (mass %) of N, Ti, B and Al respectively in the steel for machine structural use.

Also, it is preferable that, according to the necessity, the steel for machine structural use in relation with the present invention contains Cr: 3 mass % or less (excluding 0 mass %), or Mo: 1.0 mass % or less (excluding 0 mass %), or Nb: 0.15 mass % or less (excluding 0 mass %). Further, it is preferable that the steel for machine structural use in relation with the present invention contains one or more selected from a group consisting of Zr: 0.02 mass % or less (excluding 0 mass %), Hf: 0.02 mass % or less (excluding 0 mass %), and Ta: 0.02 mass % or less (excluding 0 mass %), or one or more selected from a group consisting of V: 0.5 mass % or less (excluding 0 mass %), Cu: 3 mass % or less (excluding 0 mass %), and Ni: 3 mass % or less (excluding 0 mass %).

Effects of the Invention

According to the present invention, the chemical composition of the steel for machine structural use is properly adjusted, and 4 elements of N, Ti, B and Al can be balanced well so as to satisfy a specific relation. Thus, the strength properties required for a steel for machine structural use can be satisfied, and a steel for machine structural use exerting excellent machinability (particularly, with respect to the tool life) in both of intermittent cutting with a high-speed steel tool and continuous cutting with a cemented carbide tool can be secured.

BRIEF DESCRIPTION OF THE DRAWING

FIG. 1 A drawing showing the shape of a tensile test specimen used in an example in relation to the present invention.

BEST MODE FOR CARRYING OUT THE INVENTION

In order to improve the machinability in intermittent cutting under a low speed, the present inventors made investigations from various aspects. As a result, it was found out that the machinability (particularly, with respect to the tool life) of a steel could be improved by properly adjusting the chemical composition of the steel for machine structural use and balancing 4 elements of N, Ti, B and Al well so as to satisfy a specific relation, and the present invention was completed. The reasons for limiting the range of the chemical componential composition stipulated in the steel for machine structural use in relation to the present invention are as described below.

[C: 0.05-0.9 Mass %]

Because C is an indispensable element in securing the strength required for the machine structural parts, C should be contained by 0.05 mass % or more. However, when the C content becomes excessively high, the hardness becomes excessively high and the machinability and toughness deteriorate, and therefore the C content should be 0.9 mass % or less. Also, the preferable lower limit of the C content is 0.10 mass % (more preferably 0.15 mass %), and the preferable upper limit is 0.7 mass % (more preferably 0.5 mass %).

[Si: 0.03-2 Mass %]

Si is an element effective in improving the internal quality of the steel material as a deoxidizing element. In order to exert such effect effectively, the Si content should be 0.03 mass % or more, preferably 0.07 mass % or more (more preferably 0.1 mass % or more). Also, when the Si content becomes excessively high, an abnormal structure in carburizing is formed, and hot and cold workability are deteriorated. Accordingly, the Si content should be 2 mass % or less, preferably 1.7 mass % or less (more preferably 1.5 mass % or less).

[Mn: 0.2-1.8 Mass %]

Mn is an element effective in improving the strength of the steel material by enhancing the quenchability. In order to exert such effect effectively, the Mn content is 0.2 mass % or more (preferably 0.4 mass % or more, and more preferably 0.5 mass % or more). However, when the Mn content becomes excessively high, the quenchability is enhanced too much, a supercooled structure is formed even after normalizing, and the machinablity deteriorates. Therefore the Mn content is 1.8 mass % or less (preferably 1.6 mass % or less, and more preferably 1.5 mass % or less).

[P: 0.03 Mass % or Less (Excluding 0 Mass %)]

Although P is an element (impurity) unavoidably included in the steel material, because it promotes cracking in hot working, the P content is preferable to be reduced as much as possible. Therefore, the P content is stipulated to be 0.03 mass % or less (preferably 0.02 mass % or less, and more preferably 0.015 mass % or less). It is industrially difficult to make the P content 0 mass %.

[S: 0.03 Mass % or Less (Excluding 0 Mass %)]

Although S is an element improving the machinability, when S is contained excessively high, the ductility and toughness of the steel material deteriorate. Therefore, the upper limit of the S content is 0.03 mass % (preferably 0.02 mass %, and more preferably 0.015 mass %). In particular, when the S content becomes excessively high, the quantity of MnS inclusions formed by reaction of S and Mn increases, and the inclusions extend in the rolling direction in rolling and deteriorate the toughness in the direction orthogonal to the rolling direction (toughness in a transverse direction). However, S is the impurity unavoidably included in steel, and it is industrially difficult to make the S content 0 mass %.

[O: 0.003 Mass % or Less (Excluding 0 Mass %)]

When the 0 content becomes excessively high, coarse oxide-based inclusions are formed and exert adverse effects on the machinability, ductility and toughness, as well as the hot workability and ductility of steel. Therefore, the upper limit of the 0 content is stipulated to be 0.003 mass % (preferably 0.002 mass %, and more preferably 0.0015 mass %).

[Al: 0.1-0.5 Mass %]

In order to improve the intermittent machinability, Al is required more than that required for conventional case hardening steel, and it is required to be present by 0.05 mass % or more particularly in a solid solution state. Also, because a part of Al functions as a deoxidizing agent in addition to being coupled with N and suppressing abnormal grain growth in carburizing treatment, Al is required to be contained as a total by 0.1 mass % or more (preferably 0.15 mass % or more, and more preferably 0.2 mass % or more). On the other hand, when Al is contained excessively high, Al is coupled with N under high temperature and AlN becomes liable to be formed and the hot workability deteriorates. Therefore, the upper limit of the Al content is 0.5 mass % (preferably 0.45 mass %, and more preferably 0.4 mass %).

[N: 0.002-0.017 Mass %]

N is coupled with Al, suppresses grain growth, and exerts an effect of improving the strength. In order to exert such effect effectively, the N content is 0.002 mass % or more (preferably 0.003 mass % or more, more preferably 0.004 mass % or more, and further more preferably 0.005 mass % or more). On the other hand, when the N content is excessively high, AlN is formed under high temperature and the hot workability deteriorates. Therefore, the N content is 0.017 mass % or less (preferably 0.015 mass % or less, more preferably 0.013 mass % or less, and further more preferably 0.011 mass % or less).

[Ti and/or B]

When Ti is added, TiN is formed and contributes to suppressing grain growth. Also, with majority of added Ti being coupled with N, the solid solution quantity of N is suppressed and the hot workability of the steel material improves. Because Ti-nitride is stable under high temperature, it is rarely solid resolved again even under a heated condition of 1,200° C. or above and can effectively improve the hot workability. Also, because the melting point of inclusions is lowered by that a part of Ti enters the inside of oxide-based inclusions, Ti contributes to improvement of the machinability and plays an important role in the present invention.

When B is added, B is coupled with N, forms BN, and the BN contributes to improvement of the hot workability and machinability. Although BN re-enters into solid solution under high temperature more easily compared with TiN, formation of AlN is suppressed by formation of BN again in the cooling process, and therefore the hot workability is improved. In addition, B is added also because it has also an effect of improving the machinability, and these are the important points of the present invention.

As described above, the solid solution quantity of N is suppressed and formation of AlN under high temperature is suppressed by coupling of both of Ti and B with N, and therefore the hot workability of the steel material can be improved. Accordingly, the steel for machine structural use in relation to the present invention contains at least either of Ti and B in order to improve the intermittent cutting performance instead of Ca that was used in the past for improving the continuous cutting performance.

Further, the content of Ti and B described above is in the range described below.

[Ti: 0.05 Mass % or Less (Excluding 0 Mass %)]

In order to exert the effects of Ti described above effectively, it is preferable that the Ti content is 0.001 mass % or more (preferably 0.005 mass % or more, more preferably 0.009 mass % or more, and further more preferably 0.0012 mass % or more). On the other hand, when Ti is contained excessively high, coarse TiN deteriorates the machinabiity of the steel for machine structural use. Therefore the Ti content is 0.05 mass % or less (preferably 0.04 mass % or less, more preferably 0.03 mass % or less, and further more preferably 0.02 mass % or less). Also, when Ti of a constant quantity or more relative to the N quantity to be added is added, the solid solution Ti that has not become TiN and remained in excess makes fine TiC deposit in great quantity in the cooling process of the steel for machine structural use, and therefore the machinability and toughness deteriorate. The conditions for avoiding this will be described below.

[B: 0.008 Mass % or Less (Excluding 0 Mass %)]

In order to exert the effects of B described above effectively, it is preferable that the B content is 0.0005 mass % or more (preferably 0.0006 mass % or more, more preferably 0.0007 mass % or more, and further more preferably 0.0008 mass % or more). On the other hand, when B is contained excessively high, the quenchability is enhanced excessively beyond necessity, the hardness of the steel for machine structural use becomes high, and the machinability deteriorates. Therefore the B content is 0.008 mass % or less (preferably 0.0075 mass % or less, more preferably 0.007 mass % or less, and further more preferably 0.0065 mass % or less).

The basic compositions of the steel for machine structural use used in the present invention are as described above, and the remainder is iron essentially. However, a steel for machine structural use may be used which positively contains further other elements within a range not exerting adverse effects to the actions of the present invention, not to mention that inclusion of the unavoidable impurities is allowed in the steel for machine structural use.

In the present invention, it is important that the content of the four elements of N, Ti, B and Al in the steel for machine structural use is adjusted so as to satisfy the relation of the inequalities (1)-(3) below in addition to that the chemical composition of the steel for machine structural use is adjusted to the stipulated range described above.

Inequality (1): $[N]-0.3\times[Ti]-1.4\times[B]<(0.0004/[Al])-0.002$

Inequality (2): $[Ti]-[N]/0.3<0.005$

Inequality (3): $[B]-([N]-0.3\times[Ti])/1.4<0.003$ when $[Ti]-[N]/0.3<0$, and $[B]<0.003$ when $[Ti]-[N]/0.3\geq 0$.

In the inequalities (1)-(3), [N], [Ti], [B] and [Al] represent the content (mass %) of N, Ti, B and Al respectively in the steel for machine structural use.

The content of the inequalities (1)-(3) will be described. First, the inequality (1) relates to suppression of the solid solution N quantity. The solid solution N forms AlN by coupling with Al in the cooling process of the steel for machine structural use, and deteriorates the hot workability of the steel for machine structural use. Accordingly, in the present invention, the solid solution N quantity is suppressed. More specifically, because N is coupled preferentially with Ti and B instead of Al, when Ti and B are added by a proper quantity, almost all quantity of Ti and B form nitride. Under such a premise, the left side of the inequality (1) is a value obtained by deducting the total Ti quantity and the total B quantity applied with specific factors from the total N quantity, and corresponds to the solid solution N quantity of the steel for machine structural use. Further, the right side of the inequality (1) represents the allowable quantity of solid solution N decided by the Al quantity.

Next, the inequality (2) relates to suppression of the solid solution Ti quantity. Although Ti forms TiN by adding N, when Ti of a constant quantity or more is added relative to the N quantity to be added, Ti (solid solution Ti) in excess makes a great quantity of fine TiC deposit in the cooling process of the steel for machine structural use, and deteriorates the machinability and toughness. Accordingly, by the condition of the inequality (2), the solid solution Ti quantity is suppressed to below 0.005 mass % (preferably below 0.002 mass %).

Lastly, the inequality (3) relates to suppression of the solid solution B quantity. Although B forms BN by adding N, the quenchability thereby becomes excessively high beyond necessity, and the steel for machine structural use becomes hard, and the machinability is deteriorated. Therefore, the solid solution B quantity is suppressed to below 0.003 mass % by the inequality (3).

Here, when N that cannot be coupled with Ti is present because the Ti quantity in the steel for machine structural use is small (when $[Ti]-[N]/0.3<0$), the remaining solid solution N is coupled with B in the cooling process of the steel for machine structural use. Therefore, the inequality limiting the solid solution B quantity is represented by $[B]-([N]-0.3\times[Ti])/1.4<0.003$.

On the other hand, when the solid solution N does not remain because Ti has been added sufficiently (when $[Ti]-[N]/0.30$), the inequality limiting the solid solution B quantity is represented by $[B]<0.003$.

In the steel for machine structural use in relation to the present invention, by properly controlling the chemical componential composition (balance of Ti, B, N and Al in particular) as described above, the strength as the steel for machine structural use is maintained, and the intermittent cutting performance under a low speed improves. Also, the steel for machine structural use in relation to the present invention may contain selective elements below according to the necessity. The property of the steel material is further improved according to the kind of the element contained.

[Cr: 3 Mass % or Less (Excluding 0 Mass %)]

Cr is an element effective in enhancing the quenchability of the steel material and increasing the strength of the steel for machine structural use. Also, Cr is an element effective in enhancing the intermittent cutting performance of the steel material by composite addition along with Al. In order to exert such effect, the Cr content is 0.1 mass % or more for example (preferably 0.3 mass % or more, and more preferably 0.7 mass % or more). However, when the Cr content becomes excessively high, the machinability deteriorates due to formation of coarse carbides and development of the supercooled structure. Therefore, it is preferable that the Cr content is 3 mass % or less (more preferably 2 mass % or less, and further more preferably 1.6 mass % or less).

[Mo: 1.0 Mass % or Less (Excluding 0 Mass %)]

Mo is an element effective in securing the quenchability of the base material and suppressing formation of the incompletely quenched structure, and may be contained in the steel for machine structural use according to the necessity. In order to exert such effects effectively, the Mo content is 0.05 mass % or more for example (preferably 0.1 mass % or more, and more preferably 0.15 mass % or more). Such effects are enhanced as the Mo content increases. However, when the Mo content is contained excessively high, the supercooled structure is formed even after normalizing, and the machinability of the steel for machine structural use deteriorates. Therefore, it is preferable that the Mo content is 1.0 mass % or less (more preferably 0.8 mass % or less, and further more preferably 0.6 mass % or less).

[Nb: 0.15 Mass % or Less (Excluding 0 Mass %)]

In a case hardening steel in particular among the steels for machine structural use, the surface is ordinarily hardened by carburizing treatment, however abnormal growth of the crystal grains may possibly occur during the treatment according to the temperature and duration of carburizing, heating speed and the like. Nb has an effect of suppressing such a phenomenon. In order to exert such effect effectively, the Nb content is 0.01 mass % or more for example (preferably 0.03 mass % or more, and more preferably 0.05 mass % or more). Such effect is enhanced as the Nb content increases. However, when Nb is contained excessively high, hard carbides are formed and the machinability deteriorates. Therefore, it is preferable that the Nb content is 0.15 mass % or less (more preferably 0.12 mass % or less, and further more preferably 0.1 mass % or less).

[One or More Selected from a Group Consisting of Zr: 0.02 Mass % or Less (Excluding 0 Mass %), Hf: 0.02 Mass % or Less (Excluding 0 Mass %) and Ta: 0.02 Mass % or Less (Excluding 0 Mass %)]

Because Zr, Hf and Ta have an effect of suppressing abnormal growth of the crystal grains similarly to Nb, they may be contained in steel according to the necessity. Such effect is enhanced as the content of these elements (total quantity of one kind or more) increases. However, when these elements are contained excessively high, hard carbides are formed and the machinability of the steel for machine structural use deteriorates, and therefore it is preferable to make the quantities described above the upper limit respectively. It is more preferable that the content of these elements is 0.02 mass % or less in total.

[One or More Selected from a Group Consisting of V: 0.5 Mass % or Less (Excluding 0 Mass %), Cu: 3 Mass % or Less (Excluding 0 Mass %) and Ni: 3 Mass % or Less (Excluding 0 Mass %)]

Because these elements are effective in enhancing the quenchability of the steel material and increasing the strength, they may be contained in the steel for machine structural use according to the necessity. Such effect is enhanced as the content of these elements (total quantity of one kind or more) increases. However, when these elements are contained excessively high, the supercooled structure is formed and the ductility and toughness deteriorate, and therefore it is preferable to make the quantities described above the upper limit respectively.

The steel for machine structural use in relation to the present invention is manufactured by casting and forging the molten steel added with the alloy elements described above by the quantity within the stipulated range. According to the present invention, the solid solution N quantity can be adjusted by adjusting the quantity to be added of Ti and/or B in particular, not to mention that the solid solution Ti quantity and the solid solution B quantity can be adjusted.

Also, in adding Ti, when a half, for example, of Ti quantity to be added is thrown into the molten steel before adding Al and remaining Ti is thrown in after Al is added, a part of Ti can be contained in the oxide based inclusions. Thus the machinability of the steel for machine structural use can be further improved. When Al is thrown in first and Ti is added thereafter, because Al has a stronger oxidizing power than Ti, majority of oxygen is coupled with Al, and Ti-oxide is not formed. However, when a half quantity, for example, of Ti is thrown in prior to Al, Ti can be present as the oxide.

EXAMPLES

Although the present invention will be described below more specifically referring to examples, the present invention is not to be limited by the examples described below. It is a matter of course that the present invention can be implemented with modifications added appropriately within the range adaptable to the purposes described previously and later, and any of them is to be included within the technical range of the present invention.

[Preparation of Specimen]

150 kg of steel with the chemical composition shown in Table 1 was molten in a vacuum induction furnace, and was respectively casted into ingots in a generally cylindrical shape with 245 mm in diameter in the upper surface, 210 mm in diameter in the lower surface, and 480 mm in length. Further, in Table 1, in addition to the chemical composition of the steel, the value obtained by deducting the value of the right side of the inequality (1) calculated from the chemical compositional quantity from the value of the left side, the value of the left side of the inequality (2), and the value of the left side of the inequality (3) are also shown respectively. As stipulated above, the value of the left side of the inequality (3) is the value of $[B]-([N]-0.3\times[Ti])/1.4$ when $[Ti]-[N]/0.3<0$, and is the value [B] when $[Ti]-[N]/0.30$.

TABLE 1

| Specimen No. | Chemical composition (mass %)* "—" means no addition | | | | | | | | | | | | | | Left side – right side | Left side | Left side |
|---|---|---|---|---|---|---|---|---|---|---|---|---|---|---|---|---|---|
| | C | Si | Mn | P | S | Cr | Mo | Al | Ti | B | N | Ca | O | Others | of inequality (1) | of inequality (2) | of inequality (3) |
| 1 | 0.06 | 0.21 | 1.04 | 0.012 | 0.014 | 1.01 | — | 0.24 | 0.02 | — | 0.0054 | — | 0.0010 | | −0.0003 | 0.00200 | 0.00000 |
| 2 | 0.19 | 0.19 | 0.81 | 0.011 | 0.013 | 0.58 | — | 0.25 | 0.021 | — | 0.0052 | — | 0.0012 | | −0.0007 | 0.00367 | 0.00000 |
| 3 | 0.46 | 0.21 | 0.25 | 0.011 | 0.013 | 1.03 | — | 0.22 | 0.018 | — | 0.0051 | — | 0.0011 | | −0.0001 | 0.00100 | 0.00000 |
| 4 | 0.80 | 0.36 | 0.45 | 0.009 | 0.011 | 0.99 | — | 0.20 | 0.019 | — | 0.0053 | — | 0.0009 | | −0.0004 | 0.00133 | 0.00000 |
| 5 | 0.21 | 0.92 | 0.77 | 0.013 | 0.013 | 1.01 | — | 0.21 | 0.018 | — | 0.0052 | — | 0.0012 | | −0.0001 | 0.00067 | 0.00000 |
| 6 | 0.21 | 0.22 | 0.77 | 0.012 | 0.012 | — | — | 0.11 | 0.0014 | — | 0.0020 | — | 0.0010 | | −0.0001 | −0.00527 | −0.00113 |
| 7 | 0.20 | 0.21 | 0.81 | 0.013 | 0.011 | — | — | 0.15 | 0.048 | — | 0.0146 | — | 0.0009 | | −0.0005 | −0.00067 | −0.00014 |
| 8 | 0.20 | 0.23 | 0.82 | 0.012 | 0.013 | 1.09 | 0.22 | 0.24 | 0.035 | — | 0.0091 | — | 0.0009 | | −0.0011 | 0.00467 | 0.00000 |
| 9 | 0.19 | 0.18 | 0.81 | 0.012 | 0.011 | 1.11 | 0.20 | 0.11 | — | 0.0031 | 0.0051 | — | 0.0012 | | −0.0009 | −0.01700 | −0.00054 |
| 10 | 0.19 | 0.20 | 0.78 | 0.013 | 0.013 | 1.06 | 0.17 | 0.46 | — | 0.0057 | 0.0057 | — | 0.0011 | | −0.0011 | −0.01900 | 0.00163 |
| 11 | 0.20 | 0.19 | 0.82 | 0.011 | 0.011 | 1.03 | 0.19 | 0.32 | — | 0.0071 | 0.0059 | — | 0.0009 | | −0.0033 | −0.01967 | 0.00289 |
| 12 | 0.18 | 0.24 | 0.72 | 0.012 | 0.013 | 0.99 | 0.22 | 0.11 | — | 0.0006 | 0.0021 | — | 0.0012 | | −0.0004 | −0.00700 | −0.00090 |
| 13 | 0.20 | 0.22 | 0.79 | 0.015 | 0.011 | 0.98 | 0.23 | 0.16 | — | 0.0078 | 0.0091 | — | 0.0013 | | −0.0023 | −0.03033 | 0.00130 |
| 14 | 0.19 | 0.21 | 0.77 | 0.011 | 0.013 | 1.04 | 0.21 | 0.18 | 0.015 | 0.0049 | 0.0110 | — | 0.0010 | | −0.0006 | −0.02167 | 0.00026 |
| 15 | 0.21 | 0.22 | 0.82 | 0.012 | 0.013 | 1.05 | 0.22 | 0.15 | 0.019 | 0.0017 | 0.0080 | — | 0.0011 | | −0.0007 | −0.00767 | 0.00006 |
| 16 | 0.20 | 0.22 | 0.78 | 0.014 | 0.013 | 1.02 | 0.22 | 0.32 | 0.026 | 0.0065 | 0.0140 | — | 0.0009 | | −0.0022 | −0.02067 | 0.00207 |
| 17 | 0.18 | 0.24 | 0.74 | 0.012 | 0.012 | 1.05 | 0.18 | 0.16 | — | 0.0065 | 0.0095 | — | 0.0011 | | −0.0001 | −0.03167 | −0.00029 |
| 18 | 0.19 | 0.24 | 0.69 | 0.011 | 0.014 | 1.11 | — | 0.34 | 0.022 | 0.0023 | 0.0064 | — | 0.0010 | | −0.0026 | 0.00067 | 0.00230 |
| 19 | 0.20 | 0.22 | 0.80 | 0.012 | 0.011 | 0.99 | 0.22 | 0.16 | 0.009 | 0.0030 | 0.0052 | — | 0.0012 | V: 0.21 | −0.0022 | −0.00833 | 0.00121 |
| 20 | 0.21 | 0.18 | 0.83 | 0.012 | 0.012 | 1.05 | 0.19 | 0.17 | 0.023 | — | 0.0066 | — | 0.0011 | Cu: 0.32, Nb: 0.09 | −0.0007 | 0.00100 | 0.00000 |
| 21 | 0.22 | 0.19 | 0.79 | 0.012 | 0.015 | 1.10 | — | 0.36 | 0.022 | 0.0009 | 0.0063 | — | 0.0010 | Zr: 0.01, Ni: 1.23 | −0.0007 | 0.00100 | 0.00090 |
| 22 | 0.20 | 0.19 | 0.83 | 0.014 | 0.013 | — | — | 0.19 | — | 0.0035 | 0.0047 | — | 0.0009 | | −0.0003 | −0.01567 | 0.00014 |
| 23 | 0.19 | 0.18 | 0.81 | 0.013 | 0.011 | 1.11 | 0.20 | 0.21 | 0.003 | 0.0010 | 0.0052 | — | 0.0012 | | 0.0030 | −0.01433 | −0.00207 |
| 24 | 0.21 | 0.19 | 0.79 | 0.013 | 0.012 | 1.17 | 0.15 | 0.26 | 0.037 | — | 0.0092 | — | 0.0009 | | −0.0014 | 0.00633 | 0.00000 |
| 25 | 0.20 | 0.19 | 0.81 | 0.011 | 0.013 | 1.10 | 0.19 | 0.24 | 0.0012 | 0.0078 | 0.0069 | — | 0.0011 | | −0.0040 | −0.02180 | 0.00313 |
| 26 | 0.19 | 0.18 | 0.78 | 0.012 | 0.012 | 1.08 | 0.20 | 0.07 | 0.021 | 0.0031 | 0.0120 | — | 0.0010 | | −0.0024 | −0.01900 | −0.00097 |
| 27 | 0.19 | 0.19 | 0.82 | 0.012 | 0.014 | 1.16 | 0.21 | 0.55 | 0.022 | — | 0.0093 | — | 0.0008 | | 0.0040 | −0.00900 | −0.00193 |
| 28 | 0.21 | 0.20 | 0.76 | 0.014 | 0.011 | 1.08 | 0.21 | 0.27 | — | 0.0085 | 0.0075 | — | 0.0009 | | −0.0039 | −0.02500 | 0.00314 |
| 29 | 0.21 | 0.21 | 0.81 | 0.014 | 0.013 | 1.05 | 0.22 | 0.22 | 0.0008 | 0.0004 | 0.0046 | — | 0.0012 | | 0.0040 | −0.01453 | −0.00271 |

*Remainder is iron and unavoidable impurities.

Next, by forging (soaking: 1,250° C.×approximately 3 h, heating for forging: 1,100° C.×approximately 1 h) and cutting the ingot, the ingot was worked into two kinds of forged material of (a) and (b) below after going through the quadrangular material shape of 150 mm×150 mm×680 mm.

(a) A plate material with 30 mm thickness, 155 mm width, and 100 mm length (b) A round bar material with 80 mm diameter and 350 mm length The plate material and the round bar material obtained were heated at 900° C. for 1 h, and were thereafter cooled. The plate material (forged material (a)) is used as an end mill cutting test specimen, and the round bar material (forged material (b)) is used as a lathe turning test specimen. Using these specimens, evaluation was performed on (1) the machinability in intermittent cutting and (2) the machinability in continuous cutting. Also, a specimen for evaluating the hot workability was cut out from a part of the round bar material, and (3) hot workability was also evaluated.

(1) Evaluation of Machinability in Intermittent Cutting

In order to evaluate the machinability in intermittent cutting, the wear of the tool in end mill machining was evaluated. With respect to the forged material (a) (normalized material, or hot forged one after normalizing), approximately 2 mm of the surface is removed by cutting in order to avoid the influence of the scale and the carburized layer, and thereby the end mill cutting test specimen with 25 mm thickness×150 mm width×100 mm length is manufactured. More specifically, an end mill tool was attached to a spindle of a machining center, the specimen manufactured as described above was fixed by a stock vice, and the down cut work was performed under dry cutting atmosphere. The detailed working condition is shown in Table 2. After intermittent cutting was performed by 200 cuts, the average flank wear width (tool wear quantity) Vb was measured by an optical microscope. The specimen number (No.) corresponds to the specimen number (No.) in Table 1. The specimen with 90 μm or less of Vb after intermittent cutting was evaluated to be excellent in the machinability in intermittent cutting. The result is shown in Table 3.

TABLE 2

| Intermittent cutting condition | |
|---|---|
| Cutting tool | |
| Type No. | High-speed end mill made by Mitsubishi Material K-2SL |
| Outside diameter | ϕ 10.0 mm |
| Coating | TiAlN coating |
| Cutting condition | |
| Amount of depth of cut in axial direction | 1.0 mm |
| Amount of depth of cut in radial direction | 1.0 mm |
| Feed amount | 0.117 mm/rev |
| Feed rate | 558.9 mm/min |
| Cutting speed | 150 m/min |

TABLE 2-continued

| Intermittent cutting condition | |
|---|---|
| Number of revolution | 4,777 rpm |
| Cutting atmosphere | Dry |
| Cutting length | 29 m |

(2) Evaluation of Machinability in Continuous Cutting

In order to evaluate the machinability in continuous cutting, the forged material (b) (normalized material) is removed of the scale, approximately 2 mm of the surface is thereafter removed by cutting, and thereby the lathe turning test specimen is manufactured. After the specimen was performed with the outer periphery lathe turning, the average flank wear width (tool wear quantity) Vb was measured by an optical microscope. The specimen with 100 μm or less wear width Vb was evaluated to be excellent in the machinability. The outer periphery lathe turning condition then is as described below. The result of it is also shown in Table 3 along with the result of the machinability test in intermittent cutting described above. The result is shown in Table 3.

(Outer Periphery Lathe Turning Condition)

Tool: Cemented carbide P10 (JIS B 4053)

Cutting speed: 200 m/min

Feed: 0.25 mm/rev

Depth of cut: 1.5 mm

Type of lubrication: Dry (3) Evaluation of Hot Workability

In order to evaluate the hot workability of the steel for machine structural use, a specimen with a shape shown in FIG. 1 was manufactured. Also, a test was performed in which both ends of the specimen under a state heated to 900° C. were pulled at the rate of 0.01 mm/s until the specimen was torn off, and the specimen with 40% or more area reduction ratio measured was evaluated to be excellent in the hot workability. The result is shown in Table 3.

TABLE 3

| Specimen No. | End mill flank wear quantity of forged material (a) Vb (μm) | Lathe turning flank wear quantity of forged material (b) Vb (μm) | Area reduction ratio in high temperature tensile test (%) |
|---|---|---|---|
| 1 | 57 | 70 | 53 |
| 2 | 61 | 77 | 58 |
| 3 | 53 | 84 | 46 |
| 4 | 71 | 93 | 52 |
| 5 | 82 | 72 | 48 |
| 6 | 47 | 65 | 44 |
| 7 | 53 | 88 | 53 |
| 8 | 81 | 88 | 61 |
| 9 | 76 | 74 | 52 |
| 10 | 40 | 87 | 53 |
| 11 | 75 | 97 | 67 |
| 12 | 55 | 74 | 51 |
| 13 | 62 | 89 | 65 |
| 14 | 61 | 84 | 58 |
| 15 | 65 | 82 | 54 |
| 16 | 49 | 81 | 67 |
| 17 | 56 | 75 | 52 |
| 18 | 43 | 94 | 67 |
| 19 | 63 | 94 | 56 |
| 20 | 68 | 93 | 65 |
| 21 | 59 | 88 | 64 |
| 22 | 53 | 80 | 56 |
| 23 | 50 | 99 | 31 |
| 24 | 104 | 139 | 63 |
| 25 | 113 | 126 | 53 |
| 26 | 120 | 56 | 47 |
| 27 | 93 | 118 | 29 |
| 28 | 132 | 123 | 33 |
| 29 | 63 | 80 | 32 |

[Study]

All the specimens of Nos. 1-22 belonged to the present invention, and had excellent machinability and hot workability. On the other hand, the specimens of Nos. 23-29 deviated from the stipulated range of the chemical composition or any condition of the inequalities (1)-(3), and were inferior in either of the machinability and hot workability. More specifically, the specimen No. 23 did not satisfy the inequality (1) because the balance of B, N, Ti and Al was poor, became high in the quenchability, became high in the hardness, and was inferior in the hot workability. The specimen No. 24 did not satisfy the condition of the inequality (2) because the Ti amount added was much and the balance of N and Ti was poor, became high in the hardness because Ti deposited as carbide, and was inferior in the intermittent cutting performance and continuous cutting performance. In the specimen No. 25, although the chemical composition of the steel for machine structural use was within the range satisfying the stipulation so far as it goes, the specimen No. 25 was poor in the balance of B, N and Ti, therefore did not satisfy the inequality (3), became high in the hardness, and was inferior in the intermittent cutting performance and continuous cutting performance. The specimen No. 26 was inferior in the intermittent cutting performance because Al was too small. On the contrary, the inequality (1) was not satisfied and coarse Al deposited in the specimen No. 27 because Al was too much, the specimen No. 27 was inferior in both of the intermittent cutting performance and continuous cutting performance, and was also inferior in the hot workability. Because B was much and the balance of B, N and Ti was poor, the specimen No. 28 did not satisfy the inequality (3), became high in the hardness, was inferior in both of the intermittent cutting performance and continuous cutting performance, and was also inferior in the hot workability. Although Ti and B were added, the specimen No. 29 was poor in the balance of B, N, Ti and Al, therefore did not satisfy the inequality (1), and was inferior in the hot workability of the steel for machine structural use.

The embodiments of the present invention were described as above, however the present invention is not limited to the embodiments and can be implemented with a variety of alterations being incorporated in so far as described in the claims. The present application is based on the Japanese Patent Application (No. 2009-136657) applied on Jun. 5, 2009, and its content is herein incorporated as a reference.

The invention claimed is:

1. A steel consisting essentially of:

C: 0.05-0.9 mass %;

Si: 0.03-0.36 mass %;

Mn: 0.2-1.8 mass %;

P: at most 0.03 mass % and greater than 0 mass %;

S: at most 0.03 mass % and greater than 0 mass %;

Al: 0.2-0.4 mass %;

N: 0.002-0.017 mass %;

O: at most 0.003 mass % and greater than 0 mass %;

one or more selected from a group consisting of:

Ti: at most 0.05 mass % and greater than 0 mass %; and

B: at most 0.008 mass % and greater than 0 mass %, optionally at least one of:

Cr: at most 3 mass % and greater than 0 mass %; and

Mo: at most 1.0 mass % and greater than 0 mass %, and iron and unavoidable impurities, wherein the steel satisfies all of inequalities (1)-(3) below:

inequality (1): $[N]-0.3\times[Ti]-1.4\times[B]<(0.0004/[Al])-0.002$;

inequality (2): $[Ti]-[N]/0.3<0.005$;

inequality (3): $[B]-([N]-0.3\times[Ti])/1.4<0.003$ when $[Ti]-[N]/0.3<0$, and $[B]<0.003$ when $[Ti]-[N]/0.30$;

wherein [N], [Ti], [B] and [Al] represent the content (mass %) of N, Ti, B and Al respectively.

2. The steel according to claim 1, wherein the amount of C is 0.10-0.7 mass %.

3. The steel according to claim 1, wherein the amount of Si is 0.07-0.36 mass %.

4. The steel according to claim 1, wherein the amount of Mn is 0.4-1.6 mass %.

5. The steel according to claim 1, wherein the amount of P is at most 0.02 mass % and greater than 0 mass %.

6. The steel according to claim 1, wherein the amount of S is at most 0.02 mass % and greater than 0 mass %.

7. The steel according to claim 1, wherein the amount of N is 0.003-0.015 mass %.

8. The steel according to claim 1, wherein the amount of Ti is 0.001-0.04 mass %.

9. The steel according to claim 1, wherein the amount of B is 0.0005-0.0075 mass %.

10. The steel according to claim 1, wherein:

the amount of C is 0.10-0.7 mass %;

the amount of Si is 0.07-0.36 mass %;

the amount of Mn is 0.4-1.6 mass %;

the amount of P is at most 0.02 mass % and greater than 0 mass %;

the amount of S is at most 0.02 mass % and greater than 0 mass %;

the amount of N is 0.003-0.015 mass %;

the amount of Ti is 0.001-0.04 mass %; and the amount of B is 0.0005-0.0075 mass %.

* * * * *